US005334072A

United States Patent [19]

Epstein

[11] Patent Number: 5,334,072

[45] Date of Patent: Aug. 2, 1994

[54] INFLATABLE BODY AND HOLDER ASSEMBLY

[76] Inventor: Marc I. Epstein, 1172 Park Ave., New York, N.Y. 10128

[21] Appl. No.: 846,577

[22] Filed: Mar. 5, 1992

Related U.S. Application Data

[63] Continuation-in-part of Ser. No. 753,829, Sep. 3, 1991, abandoned.

[51] Int. Cl.[5] ..... A63H 27/10

[52] U.S. Cl. ..... 446/224; 446/220

[58] Field of Search ..... 446/220–226; 40/214, 212; 383/44, 49, 57, 58, 46, 43, 51, 53

[56] References Cited

U.S. PATENT DOCUMENTS 4,486,975 12/1984 Harreld et al., ..... 446/220
4,674,532 6/1987 Koyanagi ..... 446/224 X
4,721,491 1/1988 Buchanan ..... 446/222
4,723,944 2/1988 Jensen ..... 383/44 X

FOREIGN PATENT DOCUMENTS 680192 10/1952 United Kingdom ..... 446/224

*Primary Examiner*—Mickey Yu
*Attorney, Agent, or Firm*—William E. Pelton

[57] ABSTRACT

An inflatable body, such as a balloon, and holder assembly therfor is disclosed which is adapted for use with an optional straw as a handle by which the balloon may be both inflated and thereafter held. The inflatable body and an inflation port and inner conduit are formed from a plurality of overlying and peripherally sealable panels. A holder element, such as a straw, may be inserted within the conduit such that upon inflation of the balloon the walls of the conduit are pressed against the holder to provide support for the balloon.

5 Claims, 9 Drawing Sheets

INFLATABLE BODY AND HOLDER ASSEMBLY

This application is a continuation in part of U.S. application Ser. No. 07/753,829 filed Sep. 3, 1991, abandoned.

FIELD OF THE INVENTION

The invention relates to inflatables having edge holding assemblies and more particularly to an edge holder for a balloon which permits the use of an optional straw as a handle by which the balloon may be both inflated and thereafter held, the handle being gripped by the balloon after inflation to define a reinforced edge holder assembly for the balloon. It should be understood that as used herein, the term "balloon" is used broadly to include any inflatable of any shape or size having a body portion and means for inflating the same which may but need not comprise an inflation neck or stem.

BACKGROUND OF THE INVENTION

Balloons are popular novelty items. At present, balloons are sold in two widely available forms, namely, those made of latex and those typically made of a polymer metallized film generally known as "Mylar". "Mylar" is a registered trademark of DuPont. Latex balloons are stretchable and may be sold either collapsed or inflated. "Mylar" balloons are not stretchable and may have a relatively long neck or stem. "Mylar" balloons are usually sold in inflated form, but may not be. Whether sold in inflated or uninflated form, "Mylar" balloons are usually filled to the desired pressure with air or helium and then sealed by: (a) tying the neck off with a string or the like, (b) using a clip or a cup and stick support assembly which crimps the neck and (c) heat sealing or (d) using a self-sealing valve. Regardless of the techniques for sealing that are used such balloons when filled with air may thereafter be adapted to be supported or held by means of a holder which is typically a funnel-shaped plastic cup formed at one end of a stick or a plastic shaft or the like and having means such as apertures or slots for use in securing the balloon to the cup and stick. Such holders are normally used with balloons having a diameter under about 18 inches when filled with air and which are usually sealed with heat.

Balloon holders heretofore have come in various forms. Balloon holders for "Mylar" balloons have heretofore been virtually identical to holders designed for or used with latex balloons prior to the advent of "Mylar" balloons. "Mylar" balloons of nine (9) inch and four (4) inch diameters with a self-sealing valve (recently manufactured by Convertidora Industrial, S.A. de c. v. of Mexico) also use a separate cup for support of the body of the balloon. The most popular type of balloon holder consists of a funnel-shaped cup for receiving and crimping the neck of a balloon to seal and/or secure the same. The cup is sometimes integrally attached to a stick by which the balloon is held. The cup is typically provided with a plurality of holes or slots for engaging the neck of the balloon to crimp the neck both to seal the same and/or to secure the balloon to the cup. By way of example, the neck of the balloon is threaded through and wound around the slotted cup and secured to the holder near its end. The body of the balloon is thereby intended to nest into and be supported by the funnel-shaped cup of the balloon holder. Still another type of balloon holder known heretofore, referred to as the "clip'n stick", consists of a stick with an integral loop and clip to seal and/or secure the balloon and its inlet portion.

Such prior types of balloon holders are difficult to manipulate, particularly when the balloon has been inflated (and not sealed) and one is attempting to tie off the neck by threading it through and securing it to the cup end of the holder. In addition, no matter how it is secured to the slotted cup, the balloon is not thereby firmly secured and a tendency for the balloon to disassociate itself from the cup and stick with time has heretofore been apparent. As the balloon gets loose, it is no longer centered on the holder, it tends to flop around more and more with time and may even begin to deflate if not otherwise sealed. Refilling of the balloon is cumbersome with such prior types of holders. In contrast, the present invention, when combining an inflating straw with a self-sealing valve, may be easily deflated and reinflated, when desirable or necessary. The cup and the tied-off neck of the balloon are, moreover, unsightly. Further, the rigid sticks can injure a child who falls on it; whereas the present invention uses a flexible straw which bends under slight pressure before it can puncture clothing and/or flesh. Finally, no matter how they are manufactured, the cup or non-stick portion of such balloon holders have been known heretofore to add undesirable cost to both the overall manufacturing and commercializing processes.

There are other disadvantages to the prior type of plastic cup balloon holder. These include the fact that such prior types of holders use "precious" petroleum-based plastic and constitute non-degradable waste when disposed. In addition, the difficulty of attaching the holders to the balloons has heretofore frequently placed the burden of doing so on manufacturers or distributors in advance of sale to the retailer, thereby necessitating inflation of the balloons and attachment of the cup and stick to the inflated balloon before transporting the product and increasing the cost and the storage space required to handle the product prior to sale. This difficulty has also discouraged or prevented virtually any meaningful sales of uninflated "Mylar" balloons to consumers. The present invention facilitates end user, (including children) inflation; thus providing a safe alternative to the life threatening risks of latex balloons. The U.S. government's Consumer Product Safety Counsel's August 1988 "Safety Alert on Balloon Suffocation" described as the "leading cause of accidental choking-related deaths in children under 10 years of age". As a result of this "Safety Alert" the Toy Manufacturer's Association of America members print the following on balloon packages: "SAFETY WARNING": young children could choke or be suffocated by an uninflated balloon or a piece of a broken balloon. Adults should inflate balloons and supervise their use with children under six (6) years. DISCARD BROKEN BALLOONS IMMEDIATELY!" No such warning is required for mylar balloons.

SUMMARY OF THE INVENTION

The foregoing and other disadvantages of the prior type of balloon holders are eliminated by the present invention which omits entirely the need for a balloon holder which must be tied to the neck of the balloon after inflation. In accordance with the present invention there is provided: an inflatable edge holder assembly for a balloon adapted to be inflated with an inflation medium, comprising:

an inflatable body portion having an inflation port formed therein;

means defining an inflation conduit for communicating the inflation medium from said inflation port to the interior of said inflatable body portion;

seal means for defining inflation chamber means expandable substantially to surround said inflation conduit, said inflation chamber means being open to the interior of said inflatable body portion; and a holder element releasably insertable within said inflation conduit whereby the pressure of said inflation medium within said body portion and said inflation chamber means when inflated depresses said inflation conduit against said holder element frictionally to secure said holder within said inflation conduit and with the attachment of strategically placed heat seals, defines sidewall support to hold the balloon rigidly relative to said holder element.

OBJECTS OF THE INVENTION one object of the present invention is to provide an edge holder assembly for an inflatable, such as a balloon, having means for receiving and tightly and securely gripping a suitable balloon-holding element which may comprise a stick or straw. In accordance with one aspect of the invention, a receiving channel is provided for the balloon-holding element which channel may be formed efficiently and economically during the process of heat sealing the two pieces of plastic or "Mylar" to form the balloon. The present arrangement may be used with relatively large balloons, for example having a diameter of over nine (9) inches, which would generally be too large to be affixed to and properly supported by the prior type of stick-with-cup holder.

Another object of the present invention is to provide an edge holder assembly for such an inflatable which secures the inflatable to a balloon-holding element in such a way as to eliminate the cost of the prior type of balloon-holding stick-with-cup, eliminate the labor required to attach the balloon to such stick-with-cup holder, efficiently and economically form the edge holder coincident with present day sealing processes and provide a more reliable attachment and vertical retaining assembly.

Yet another object of the present invention is to provide an edge holder assembly for such an inflatable which may be used in conjunction with either a heat sealed closure for the balloon or a self-sealing valve.

Still another object of the present invention is to provide an edge holder assembly for such an inflatable which enables the inflatable to be quickly and easily inflated, sealed and affixed to a holder thereby to facilitate inflation by retailers or the public so as to reduce costs heretofore incurred for shipping inflated balloons with sticks and/or cups attached and to eliminate concomitant costs for damaged or unsalable "leakers".

A further object of the present invention is to provide an edge holder assembly for such an inflatable which permits the inflatable to be manufactured from lighter gauge plastic than has heretofore been necessary to avoid or minimize shipping and handling damage to pre-inflated balloons.

A still further object of the present invention is to provide an edge holder assembly for such an inflatable comprising a stick or straw balloon holder combination that, by facilitating consumer inflation and assembly, opens new markets for air filled plastic balloons, such as self-service mass merchandiser multi-packs, greeting cards, manufacturer and retailer premiums, advertising specialties, direct mail inserts and point of purchase signs. As a non-limiting example, the spine of a common greeting card 70 and 73 may be perforated or formed with pre-cut or die-cut slots 71 and 74, as illustrated in FIGS. 7 and 8, to receive and secure thereto a stick 72 and 75 attached to the balloon as a balloon holder in accordance with the present invention. In this way, the greeting card may be adapted to serve as a stand for the balloon. The card, stick and balloon may be sold as a kit for assembly by the purchaser.

A yet further object of the present invention is to provide an edge holder assembly especially adapted for metallized balloons that will enable such balloons to fully exploit their advantages vis-a-vis latex balloons of being easier to inflate and seal, safer for children more attractive and more suitable for graphics and messages and less likely to burst or otherwise lose air.

All of the above economies and benefits of the present invention can more than justify the incremental cost of self-seal valves, vis-a-vis heat seals, for smaller air-filled balloons. Absent such benefits, self-seal valves heretofore represented an unnecessary, uneconomical extra cost for pre-inflated, pre-assembled state-of-the-art balloons.

BRIEF DESCRIPTION OF THE DRAWINGS

For a further understanding of the present invention reference may be had to the following drawings in which.

BRIEF DESCRIPTION OF THE PREFERRED EMBODIMENTS

Figure 1:
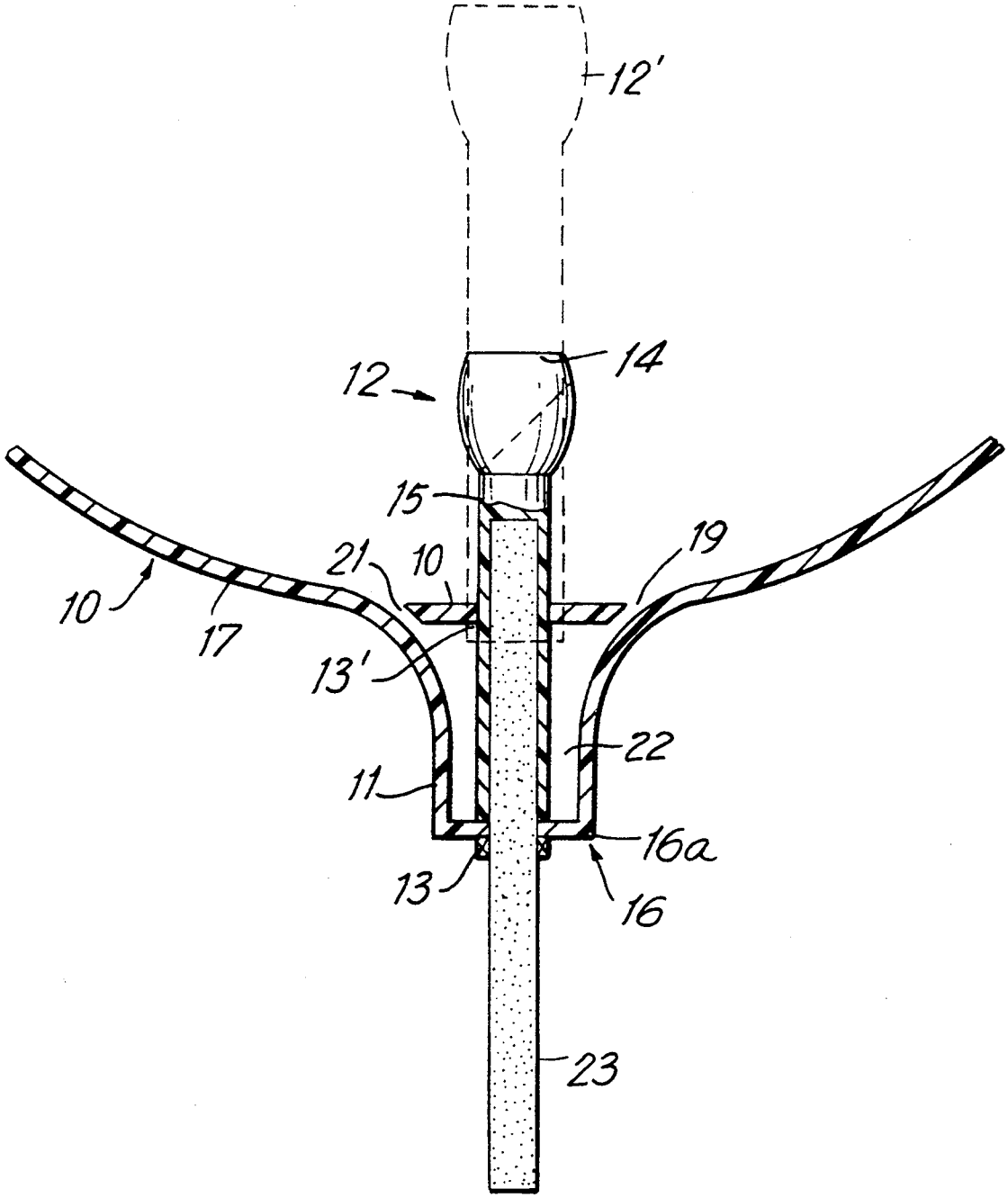
FIG. 1 is a fragmented elevational section of an inflatable showing the part thereof which includes a self-sealing valve and edge holder assembly, the inflatable being formed within a depending neck or stem according to one embodiment of the present invention.

Referring now to the drawings, and in particular to FIG. 1, there is shown an inflatable or balloon body generally indicated by reference numeral 10 having a depending neck or stem portion 11. It will be understood that in the preferred embodiment the balloon 10 may be formed from a pair of superimposed and heat-sealable panels or sheets of the non-latex or "Mylar" type laminate material, although the present invention is not to be limited to the particular material used for the inflatable object involved.

In the present embodiment, the depending neck or stem portion or passageway 11 forms part of an edge holder assembly through which an inflation medium or fluid such as, for example, air is ordinarily supplied for inflating the balloon. The edge holder assembly for the balloon according to the present embodiment also includes a self-sealing valve 12. The valve 12 may be formed separately from suitable plastic material and inserted between overlying panels of the balloon body at the time of manufacture of the balloon or may be formed together with the balloon, as desired. The valve 12 may consist of a tubular valve body 15 having a central longitudinal passage or inflation conduit **15*a* therethrough (FIG. 3), each end of which defines a port for the passage of the inflation fluid. Although the invention is not to be limited thereby, several types of self-sealing valves are known in the art and may be utilized. For example, there is no requirement that the self-sealing valve have a tubular configuration. Nor is it required that the inflation conduit traversing the self-sealing valve be linear along its entire length. Many types of self-sealing valves and configurations therefor may be found to have utility in connection with the present invention. In one example of such a self-sealing valve, a generally tubular body thereof may generally be formed from a pair of coterminous flexible plastic sheets defining inlet and outlet ports 13 and 14, respectively. When installed in the edge of the balloon, the inlet port 13 may, by way of example, extend beyond the distal end or boundary 16** of the balloon stem, as depicted in FIG. 1.

Suitable self-sealing valves are shown and described in detail in U.S. Pat. Nos. 4,560,360, 4,672,532, 4,917,646 and 4,983,138. These and other types of self-sealing valves, including a type of integral self-sealing valve formed out of the two halves of the balloon itself, may be used without departing from the scope of the present invention.

In the case of non-latex type balloons, the inflatable balloon may consist of a pair of superimposed metallicized and heat sealable sheets **20*a*, 20*b* (FIG. 3 ) made of foil, metallized fabric or nylon, vinyl and polymers, polypropylene and the like. The sheets 20*a* and 20*b* forming the balloon are typically sealed together at their peripheral edges to define the particular shape of the balloon as indicated by edge seal 17. The edge seal 17 also extends smoothly and continuously along the periphery of the depending stem 11 of the balloon and along the distal end or lower stem boundary 16**.

The self-sealing valve 12 is preferably located to lie within and along the longitudinal center axis of the stem 11 such that the outlet port 14 of the valve lies entirely within the balloon. The inlet port 13 of the valve may be coterminous with the stem boundary 16 or extend outwardly a small distance therebeyond as shown by way of example in FIG. 1.

The tubular body 15 of the self-sealing valve 12 may be formed of plastic sheets **15*b*, 15*c* (FIG. 3) each of which may be integrally fused, such as for example by a suitable heat seal bond, along a lower transverse boundary seam 16*a* to a corresponding overlying one of the sheets forming the stem 11 in the final assembled balloon state, as desired. As is well understood in the relevant art, this ensures integral fusing of the valve inlet 13 to the balloon stem 11** without closure thereof.

In the preferred embodiment, a secondary bond or seal 18 between the balloon defining sheets and the corresponding sheets of the valve 12 may be provided inwardly of the boundary 16 and boundary seal **16*a*. The secondary seal 18 transversely bonds the sheets 20*a*, 20*b* (FIG. 3) forming the body of the balloon together on opposite sides of the body of the self-sealing valve 12 for a predetermined lateral distance. The secondary seal 18 also bonds the balloon sheets 20*a*, 20*b* (FIG. 3) to the plastic sheets 15*b*, 15*c* (FIG. 3) of the valve 12, in the same manner as is done at seal 16*a* at or about the inlet 13 of the valve. The secondary seal 18 is therefore discontinuous with the boundary seal 17 and between its opposite ends and the seal 17 defines a pair of openings 19 and 21 of predetermined size whereby the interior of the stem 11 constitutes a secondary inflatable chamber 22 in fluid flow communication with the interior of the balloon body 10. The chamber 22 is preferably expandable so as substantially to surround the valve 12**.

Inflation of the balloon is facilitated with the use of a fill tube 23 which is insertable into the central passage of the self-sealing valve 12 for a distance dictated by the exact nature and configuration of the valve 12. Preferably, the fill tube 23 is insertable up to a point just beyond the secondary seal 18. In this way, the fill tube is generally "strapped" in position within the valve 12 and is supported against lateral movement within the stem 11 and the valve 12 by the two spaced-apart seals **16*a* and 18** which also serve to grip the fill tube. As is understood in the art, the fill tube may be prevented from going too far into the central passage of the self-sealing valve by a spot seal in the center of the passage or by an indentation, bend or other constriction of the valve, which may be "hour glass" or "L-shaped" or "pod-shaped" in configuration. It is desirable that the fill tube be physically prevented from causing the sealing mechanism of the valve to open or leak, although such a configuration for the self-sealing valve is not an essential component of the present invention.

When the fill tube 23 is in proper position in the valve 12, a pressurized inflation fluid (e.g., blown air) is communicated through the fill tube and valve 12 and exits from outlet port 14 into the interior of the balloon body to inflate the same. When the balloon is filled to a predetermined pressure, the input pressure of inflation fluid is removed and the valve 12 seals itself in a known manner to prevent egress of the pressurized fluid within the balloon through the valve and fill tube which would otherwise promptly deflate the balloon.

The fill tube 23 may preferably be composed of a suitable semi-rigid or rigid plastic, metal, paper or straw material, although the invention is not to be limited by the nature or type of fill tube used to inflate the balloon. In particular, the fill tube 23 may comprise a standard drinking straw.

The pressurized fluid within secondary inflatable chamber 22 substantially surrounds and presses against the tubular body portion of the valve 12 which lies between the outer and inner seals 16*a* and 18 and thereby serves to support the fill tube or straw 23. This extra support for the straw enables the straw to function as a handle for the balloon. In essence, the inflation of the balloon body and secondary chamber 22 within the stem provides sidewall rigid support for the straw along its length and serves to lock the straw in place and to support the straw and the balloon in an upright position. The fill tube 23 may be of any suitable length or have tapered ends (not shown) to define nestable end portions for purposes of extension, as desired.

While the tubular self-sealing valve is shown with its inlet port 13 extending outwardly a small distance beyond the lower boundary 16 of the balloon stem 11, the invention is not to be limited by such a structure. As indicated by the broken lines in FIG. 1, the inlet port 13' of the tubular body of the valve, indicated by reference numeral 12' may be located adjacent the secondary heat seal 18 so that the entire body of the valve protrudes into the interior of the body of the balloon in this arrangement, the self-sealing valve 12' is entirely above the straw or stick 23 without the latter entering the body of the valve.

Figure 2:
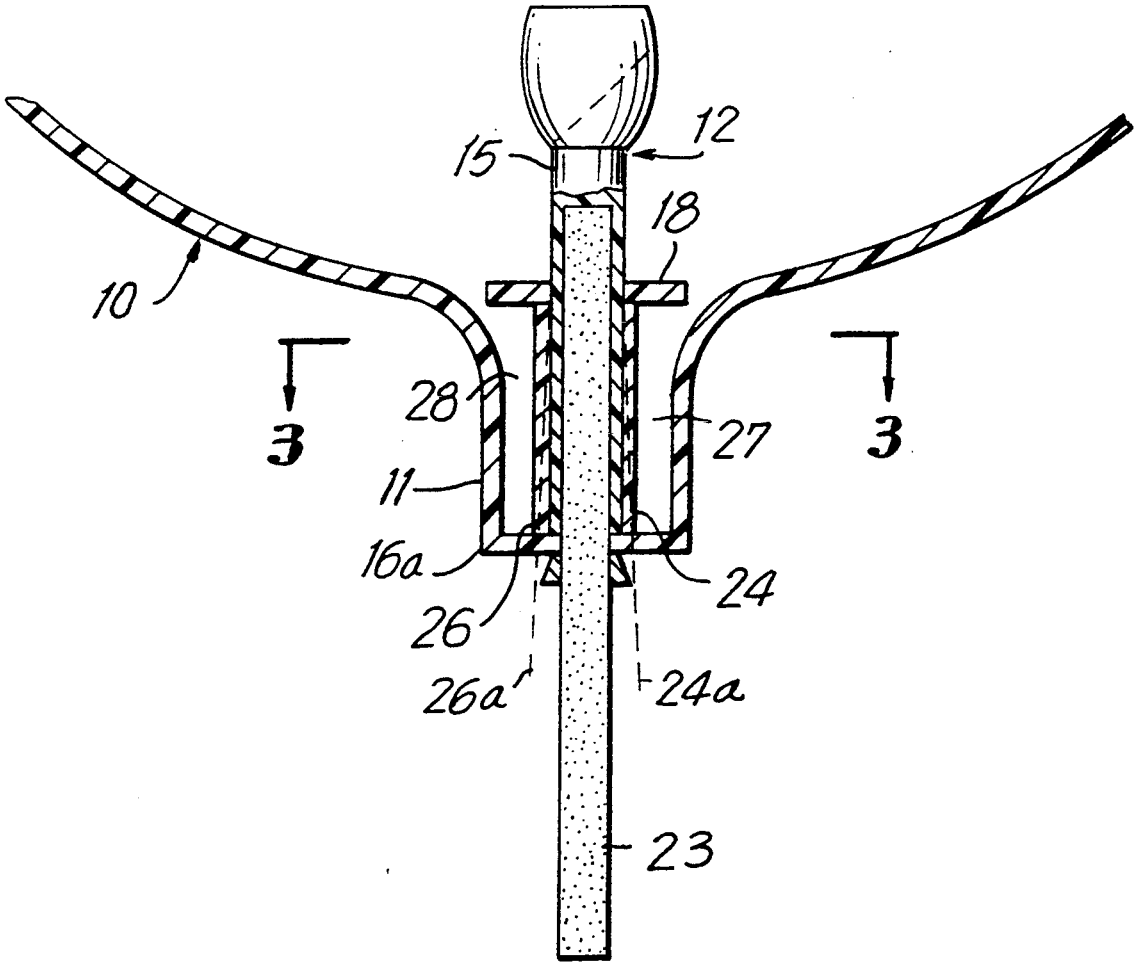
FIG. 2 is a fragmented elevation section of an inflatable showing the part thereof which includes the self-sealing valve and edge holder assembly for an inflatable of the type shown in FIG. 1, according to another embodiment of the present invention.
Figure 3:
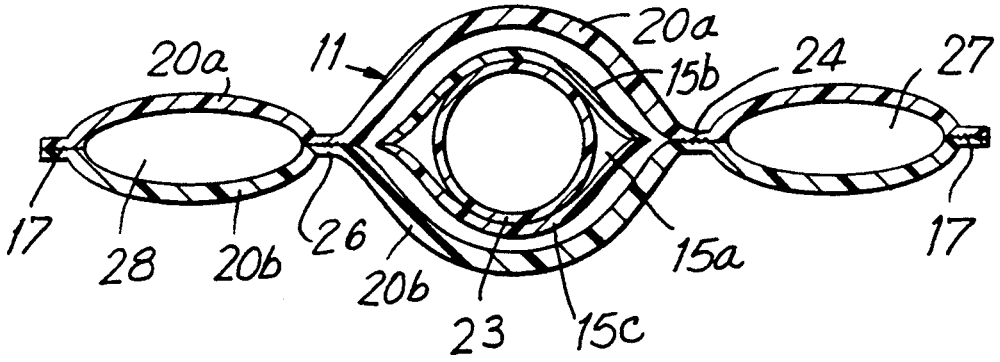
FIG. 3 is a view taken along the line 3—3 of FIG. 2.

Referring now to FIGS. 2 and 3, there is shown another embodiment of the present invention. The structure shown in FIGS. 2 and 3 is essentially the same as that of FIG. 1 except that additional support is shown for the fill tube or straw 23. In this embodiment, a first and second substantially straight and parallel heat seals 24 and 26 are formed longitudinally along the length of the stem 11, one on each side of the tubular body 15 of the self-sealing valve 12. The heat seals 24 and 26 extend from the lower boundary seam 16*a* of the stem 11 to the upper heat seal 18 which, in FIG. 1, defines the secondary chamber 22. The two longitudinal heat seals 24 and 26 provide even further support for the fill tube or straw 23 and function to secure it in a fixed position relative to the stem 11. In addition, such longitudinal heat seals 24 and 26 divide the secondary chamber 22 (FIG. 1) into a pair of parallel and longitudinally extending inflatable rib-like chambers 27 and 28. When inflated together with the balloon, the rib-like chambers 27 and 28 expand to rigidly press against the straw to provide sidewall pressure to hold the balloon in a fixed, normally upright, position. As was true in the embodiment of FIG. 1, the pressure of the inflated rib-like chambers 27 and 28 against the straw serves frictionally to secure the straw in position so that it will not easily disengage from the valve or balloon stem to enable it to function as a holder for the balloon.

It will be understood by those skilled in the present art that the heat seals 24 and 26 need not be straight and parallel. They may be curved or non-parallel, for example tapered inwardly against the tubular body 15 of the self-sealing valve 12, as shown by broken lines 24*a* and 26*a* in FIG. 2. Such non-parallel seals would serve to crimp or restrict the fill bore or filling passageway defined within the stem 11 for the straw or stick 23 thereby providing a friction fit for the straw or stick so as to secure it in position inside the fill bore or filling passage.

It should be understood that the invention is not to be limited to providing only a single secondary chamber or a pair of sidewall inflatable rib-like chambers such as the chambers 27 and 28. Persons skilled in the art will realize that depending upon the overall width of the stem 11, the longitudinally extending substantially parallel heat seals 24 and 26 need not lie directly along or be attached to the edges of the self-sealing valve, but also may be spaced therefrom to define yet another pair of interior inflatable rib-like chambers between the inflatable rib-like chambers 27, 28 and the valve 12. In such an embodiment, the edge holder assembly of the present invention would comprise four separate but communicating longitudinal rib-like chambers to support the straw with even greater rigidity, as desired. Indeed, the number of such longitudinal heat seals along the stem 11 and the number of parallel and inflatable rib-like chambers that would be created or defined thereby will be understood by those skilled in this art to vary only with the overall nature and configuration of the stem 11 and of the balloon 10.

Figure 4:
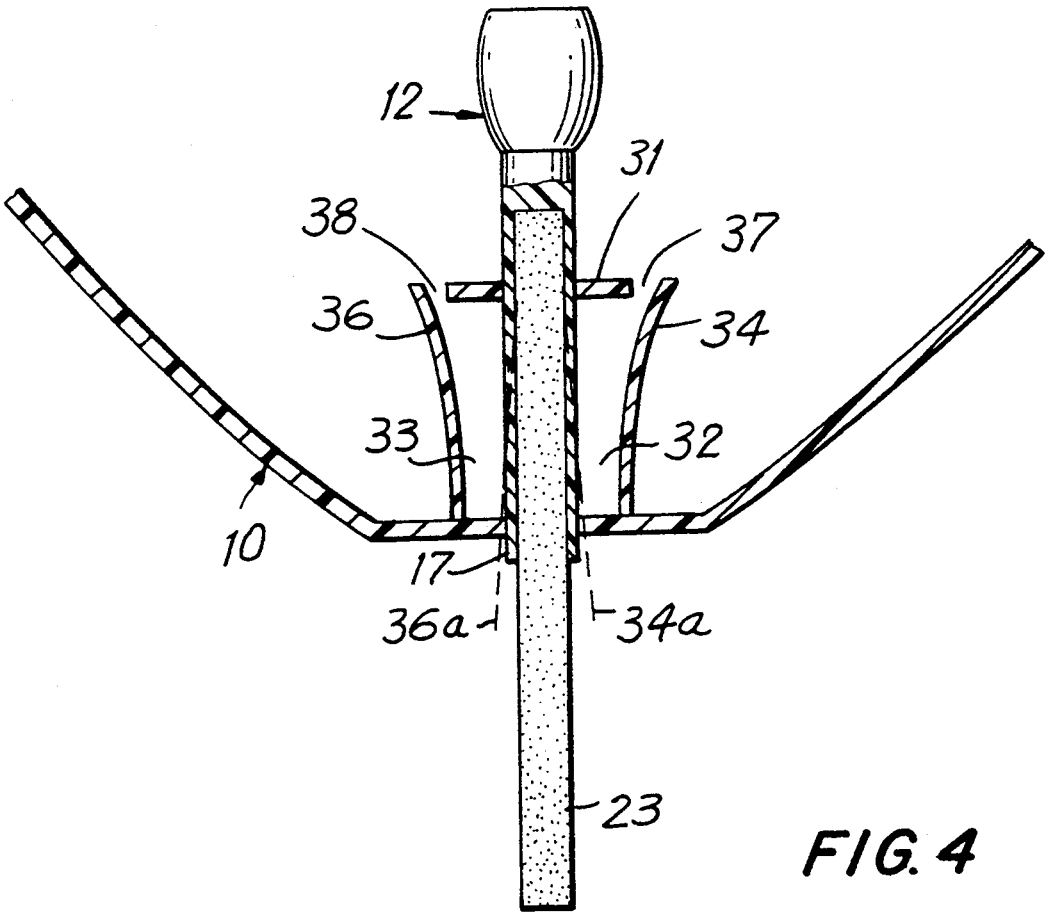
FIG. 4 is a fragmented elevation section of an inflatable showing the part thereof which includes a self-sealing valve and edge holder assembly formed within an inflatable according to yet another embodiment of the present invention.

Referring now to FIG. 4, there is shown yet another embodiment of the present invention in which the edge holder assembly according to the invention is located within the body 10 of the inflatable such as a balloon. In this embodiment, the balloon 10 does not have a depending neck or stem such as shown in the embodiments of FIGS. 1 and 2. The self-sealing valve 12 traverses the edge seam 17 defining the contours of the balloon body 10 and extends inwardly toward the center of the balloon, as shown in FIG. 3. A secondary heat seal 31, similar to the heat seal 18 of the embodiment of FIGS. 1 and 2 is formed across the tubular body of the valve 12 inwardly of the edge seam 17. In this way, the valve 12 is held in position by the pair of heat seals including the edge seam 17 and the secondary seal 31.

In this embodiment, sidewall supporting rib-like chambers 32 and 33 may be formed by supplemental inwardly extending and substantially parallel sidewall seals 34 and 36, respectively. The seals 34 and 36 extend inwardly toward the secondary seal 31 and preferably terminate near respective opposite ends thereof to define access ports 37 and 38 through which the inflation medium passes to inflate the rib-like chambers 32 and 33, respectively. As was the case with respect to the embodiments of FIGS. 1 and 2, the combination of the edge seal 17, secondary seal 31 and the lateral sidewall pressure exerted against the valve body and an inserted straw 23 by the inflated rib-like chambers 32 and 33 serves frictionally to secure the straw in position and to support the same rigidly so that the straw may remain in place after inflation of the balloon and function as a holder for the balloon. Balloons constructed in accordance with the embodiment of FIG. 4 may have the further advantage or benefit of improving the yield per square feet of plastic film utilized during the manufacturing process in that the neck or stem area is eliminated. In addition the amount of unusable waste film generated at the balloon periphery by the edge seal that forms the body of the balloon is minimized.

It will be recognized by those skilled in the art that the sidewall seals 34 and 36 need not be spaced from the tubular body of the self-sealing valve 12. They may, if desired, lie contiguously along and conform to the side edges of the valve. Such an arrangement would eliminate the rib-like chambers 32 and 33 but the equivalent rigidity could be achieved by a bond between the overlying panels defining the body of the balloon and the corresponding body portion of the valve as well as by the pressure of the inflation fluid within the body of the balloon against the valve and the inserted straw or stick. The inflation fluid within the balloon would surround and press against the self-sealing valve and straw or stick therein to support the same in a like manner to the support described above with respect to the rib-like chambers. In such an arrangement, the sidewall seals 34 and 36 may also be curved or non-parallel so as to approach each other inwardly from the edge of the balloon to crimp or restrict the fill passage to provide an additional frictional grip on the self-sealing valve and straw or stick therein, as shown by broken lines 34*a* and 36*a* in FIG. 4.

In some cases, the inflation conduit or fill bore may be separate and apart from the edge assembly holder channel. In such a situation, the self-sealing valve may be eliminated and the balloon provided with a separate inlet for inflation fluid elsewhere around its periphery. The sidewall seals 34, 36 or 34*a*,36*a* (tapered) may then be used to define an inwardly extending channel used solely to receive the holding implement. Such a channel is preferably terminated by a lateral seal, such as the secondary seal 31, but which extends completely across the innermost ends of the sidewall seals. The holder channel may then receive a suitable holding implement, such as a stick or even a straw, as desired. It should be understood that the inflation conduit and/or the holder channel may be formed in the manner described herein at any suitable location on the body of the balloon. It may project radially inwardly, as shown, or in the case of a substantially non-circular balloon, it may extend inwardly parallel and/or near to any suitable edge of the body of the balloon.

Figure 5:
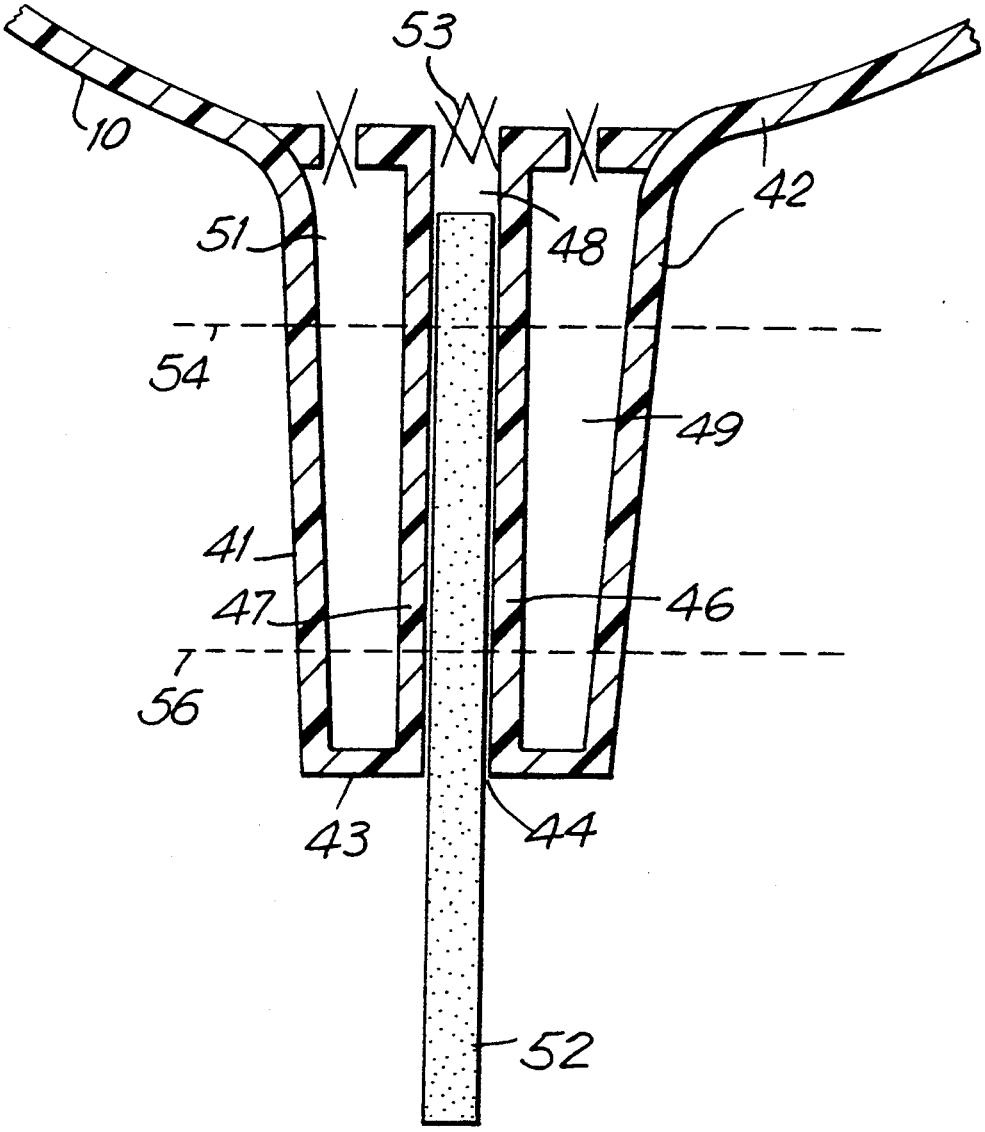
FIG. 5 is a fragmented elevation section of an inflatable showing the part thereof which includes an edge holder assembly according to still another embodiment of the present invention in which the edge holder assembly is formed within a depending neck or stem of the balloon body but without a self sealing valve structure therein.

Referring now to FIG. 5, there is shown still another embodiment of the present invention in which the balloon body 10 is formed with a depending neck or stem 41 but without a self-sealing valve structure therein. In this embodiment, the peripheral edges of the stem 41 are formed by a seam 42 which also defines the peripheral edges of the body 10 of the balloon. The lower boundary 43 of the stem 41 is defined by a pair of transverse seams which extend inwardly toward each other from the seam 42 but do not touch thereby leaving an opening 44 therebetween communicating with the interior of the balloon body. A pair of parallel and spaced apart heat seals 46 and 47 extend longitudinally along the stem 41 in an inward direction and preferably at least along the entire length of the stem. The opening 44 and the heat seals 46 and 47 thereby define an inflation conduit or fill bore 48 formed substantially along the center line of the stem. In addition, heat seal 46 and edge seam 42 define a first sidewall rib-like chamber 49 between them, while heat seal 47 and edge seam 42 define a second sidewall rib-like chamber 51 between them. The rib-like chambers 49 and 51 are open at the top, i.e. at the interior ends, so as to be in fluid flow communication with the interior of the balloon.

The fill bore 48 is adapted to receive a suitable holder or handle element 52, which may be a straw or stick, and by which the balloon may be held upon full inflation thereof and of the rib-like chambers 49 and 51. Preferably the handle element 52 is a standard drinking straw which may also be used to blow air into and thereby inflate the balloon. Once the balloon is inflated to a predetermined pressure, a heat seal or other suitable bond may be formed across the inner end 53 of the fill bore 48 to prevent egress of the inflation medium through the fill bore or .straw inserted therein. As described above in connection with other embodiments, the sidewall rib-like chambers 49 and 51 are filled with the inflation medium thereby to press against and rigidly support the length of the straw which is located within the fill bore 48. The inserted straw is thereby held secure by the air-filled side walls of the stem 41. If desired, the inner ends of the longitudinal rib-like chambers 49 and 51 may also be sealed so as to trap the air within the chambers after inflation of the balloon. Moreover, it may also be desirable to provide one or more additional lateral heat seals, indicated by broken lines 54 and 56 at FIG. 5, across the stem 41 and fill bore 48 to provide additional support for the straw or stick 52. Persons skilled in the art will recognize the circumstances under which such additional seals would be desirable. In addition, it will be understood that the balloon may be inflated with a hand or motor powered pump (without the use of a straw) within the fill bore 48 and that the bond sealing off the inner end of the fill bore 48 may be formed before insertion of the straw or stick-type holder therein.

Figure 6:
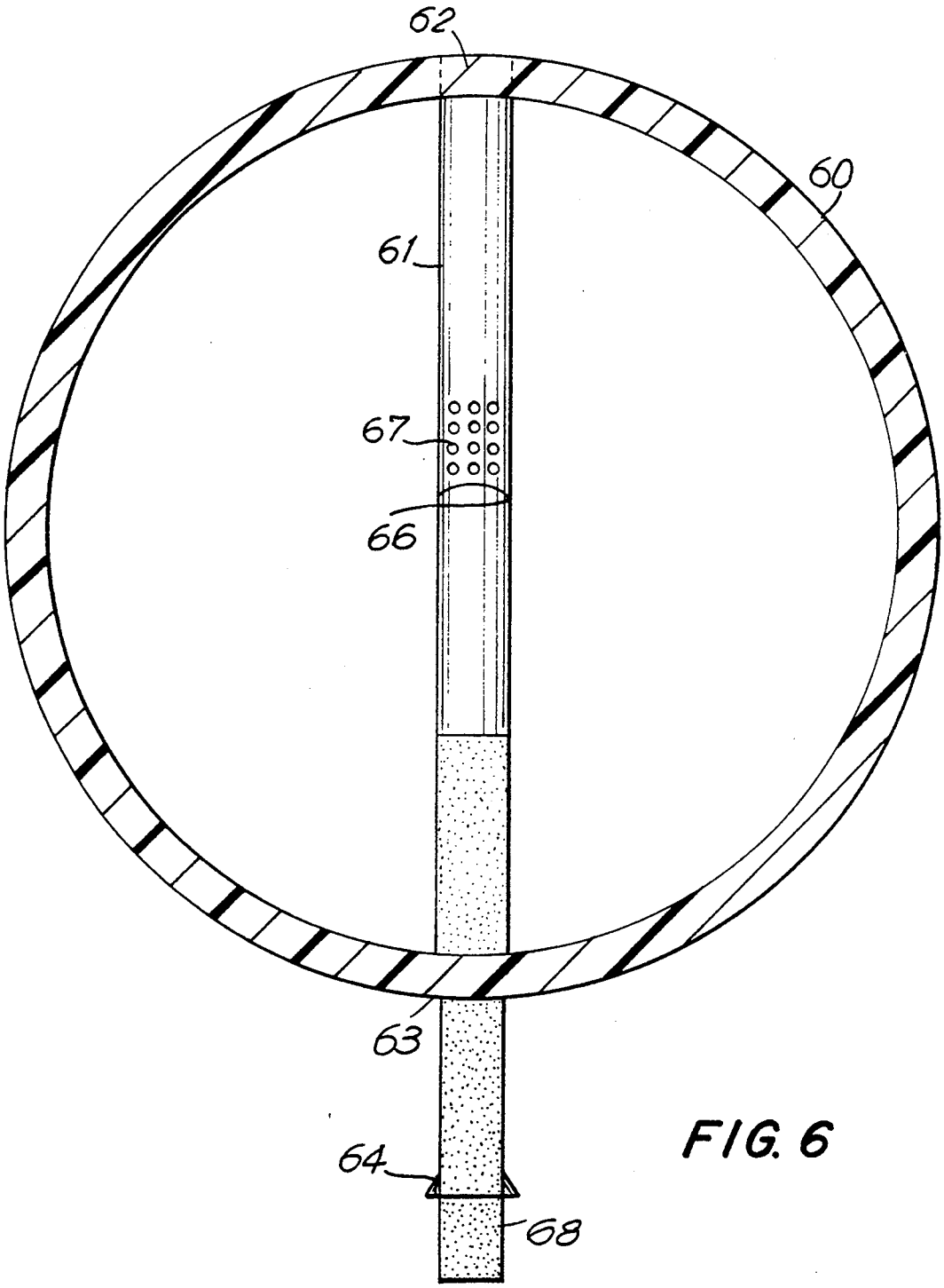
FIG. 6 is a sectional view of an inflatable showing an edge holder assembly according to yet another embodiment of the present invention.

Referring now to FIG. 6, there is shown a balloon body 60 in which a self-sealing valve 61 extends substantially diametrically within the balloon body from one edge seal 62 to an opposite edge seal 63. It will be understood, however, that the invention is not to be limited by the precise location of the valve within the body of the balloon 60. In the present embodiment, the valve 61 extends outwardly beyond the periphery of the balloon at one edge seal, for example at edge seal 63, to define a suitable inlet port 64. The valve contains a known type of self-sealing mechanism 66 within the body of the balloon at a predetermined distance from the inlet port 64. The valve body may also be provided with a plurality of air holes 67 within the balloon and situated such that the self-sealing mechanism 66 lies between the air holes and the inlet port.

The valve 61 is shown to be of the tubular type into which a fill tube 68, such as a straw may be inserted, although as mentioned hereinabove the present invention is not to be limited by the overall shape or configuration of the particular self-sealing valve selected. As described with respect to the embodiment of FIG. 4, the tubular portion of the valve may be crimped or restricted somewhat by suitably non-parallel inwardly projecting sidewall seals (not shown) adapted to provide a friction fit for the straw within the valve. The straw may thereby function securely as a balloon holder held in place both by the friction fit and by the pressure exerted against it as a result of inflation of the balloon.

Figure 7:
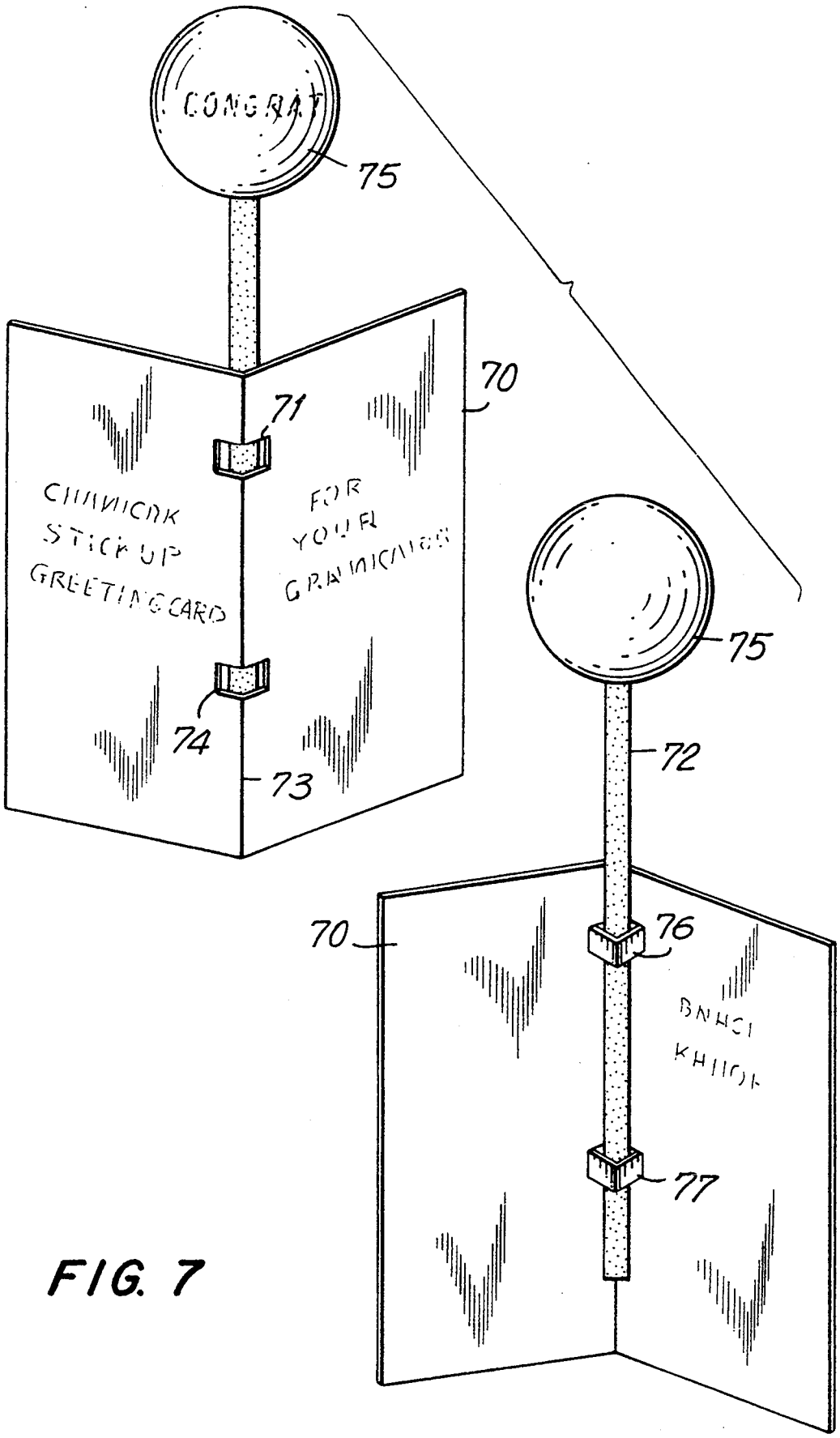
FIG. 7 constitutes perspective views of the outside and inside of a greeting card adapted in accordance with the present invention to support a balloon holding stick releasably secured thereto and supported thereby which greeting card thereby serves as a stand for the balloon and stick.

Referring now to FIG. 7 there is shown a party balloon 75 held by a stick 72, the stick 72 being supported by an ordinary greeting card 70. The stick 72 is preferably supported along a spine 73 of the card 70. By way of example, the spine 73 may be provided with one or more die cuts 71 and 74 which may be of any desired shape. In the present embodiment the die cuts are in the form a spaced apart pair of parallel lines orthogonal to the spine 73 and comprising parallel cuts such that when pushed inwardly define a pair of inwardly projecting straps or loops 76 and 77 to support the stick 72 of the balloon. In this embodiment the stick thereby extends vertically along the inside of the greeting card as defined by the fold in the card. It should be understood that greeting cards having multiple folds may support one or more such balloons and sticks.

Figure 8:
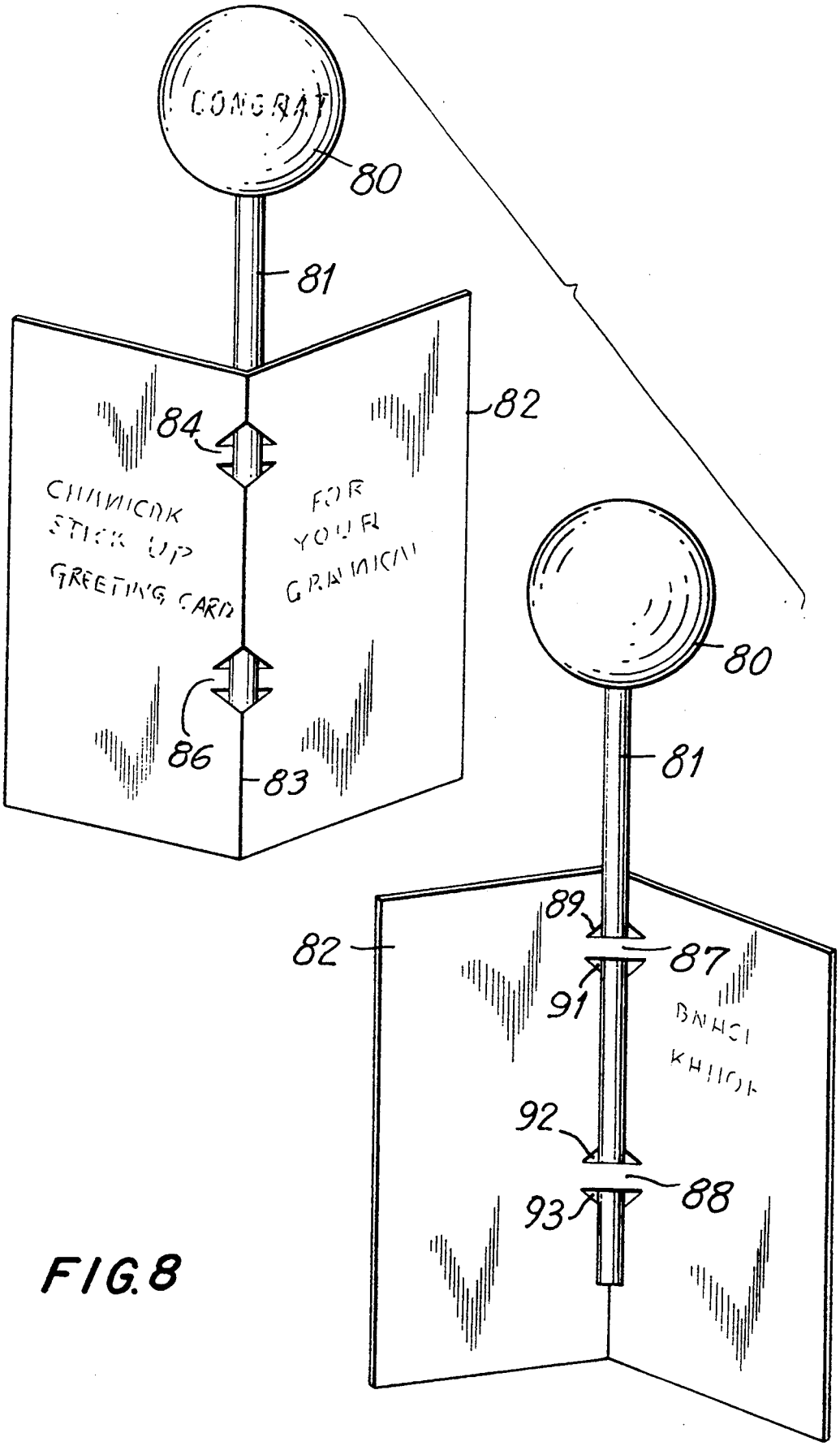
FIG. 8 constitutes perspective views of the outside and .inside of a greeting card adapted in accordance with an alternate embodiment of the present invention to support a balloon holding stick releasably secured thereto and supported thereby as shown in FIG. 7 in which the greeting card contains an alternative die cut along the spine of the card.

It will be evident to those skilled in the art that other forms of die cuts may be used to support the stick 72 without departing from the scope of the present invention. For example, another embodiment of such a greeting card support or stand structure is shown in FIG. 8. There, a balloon 80 is affixed to a stick 81 which in turn is supported by an ordinary greeting card 82 of the type depicted in FIG. 7. As in the embodiment of FIG. 7, the stick 81 is preferably held along the spine 83 of the greeting card. One or more die cuts 84 and 86 are arranged along the spine 83 and are designed to provide inwardly projecting straps or loops 87 and 88 to support the stick 81. In this embodiment, the strap or loop 87 is defined by a pair of upper and lower triangular-shaped cut-outs 89 and 91 while the strap or loop 88 is defined by a similar pair of cut-outs 92 and 93. Said triangular shaped cut-outs add space on the top and bottom of the strap or loop; thus facilitating the entry and exit of the straw as it is inserted through the strap/loop. The stick 81 thereby extends through the loops 87 and 88 vertically along the inside of and is supported by the greeting card 82 as defined by the fold in the card.

Figure 9:
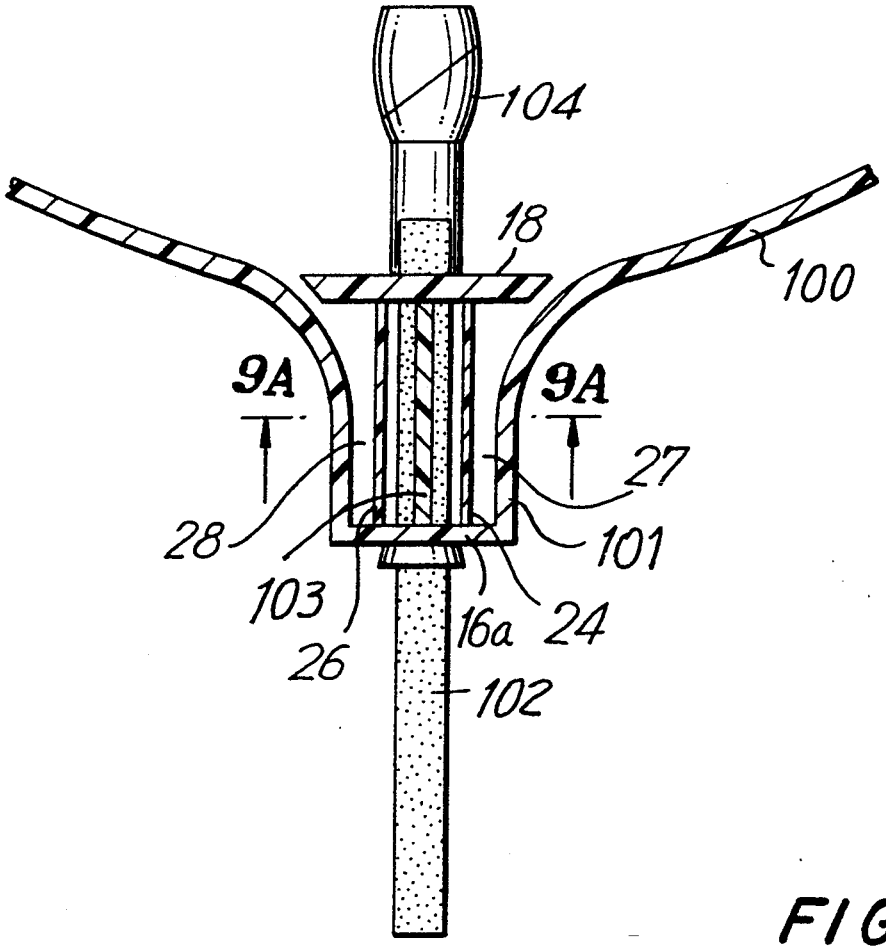
FIG. 9 is a fragmented elevational section of an inflatable showing the part thereof which includes a self-sealing valve and edge holder assembly of the type depicted in FIG. 1 and illustrating a further embodiment of the present invention.

Referring now to FIG. 9, there is shown a further embodiment of the present invention in which the edge holder assembly according to the invention is formed within a balloon 100 having a depending neck or stem 101. The structure shown in FIG. 9 is similar to that of FIG. 1 except that alternative support is shown for the fill tube or straw 102. The alternative support may be in the form of one or more longitudinally extending heat seals. 103 formed along at least one side of the length of the stem 101 and stick 102 as are the heat seals 24 and 26 depicted in FIG. 2 but out of phase from heat seals 24 and 26 by approximately 90 degrees. The heat seals 103 are preferably formed on diametrically opposite sides of the stick 102. In one embodiment, the heat seals 103 may define seams between the material of the stem 101 and the material of the body 104 of a type of self-sealing valve protruding inwardly of the balloon 100.

Figure 9A:
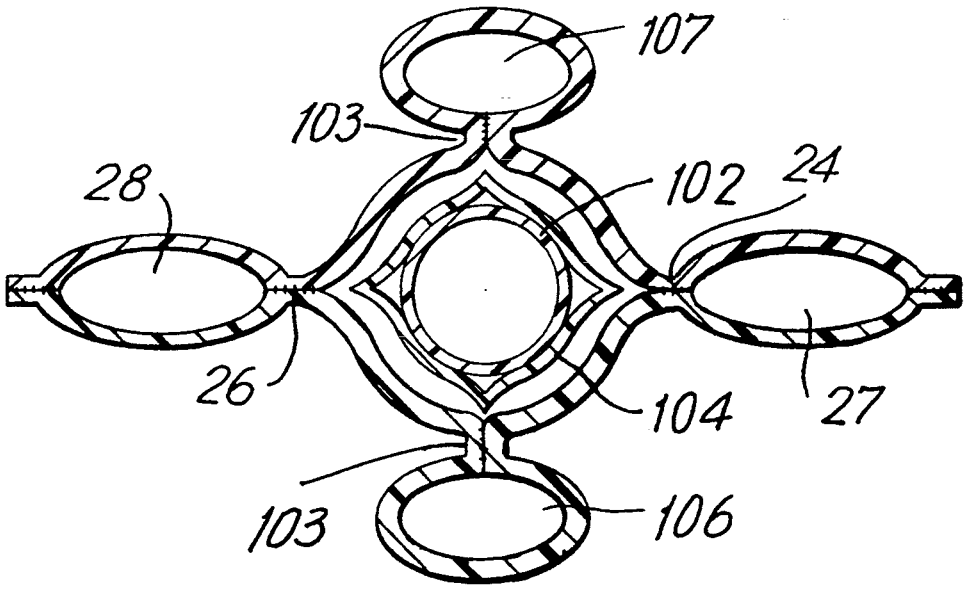
FIG. 9A is a cross sectional view taken along the line 9A—9A of FIG. 9.

With reference to the embodiment of FIG. 9A, the heat seals 103 may also define seams between opposed portions of the material of the stem 101 so as to define vertically extending inflatable chambers 106 and 107 lying along opposite sides of the stick 102 in much the same manner as the seals 24 and 26 define the inflatable chambers 27 and 28 described herein with respect to FIG. 3. Such an arrangement could provide a total of four inflatable chambers spaced around the stick 102 at approximately 90 degree intervals and would establish positive support for the balloon. It will be understood that whether two or four such inflatable chambers are utilized may appropriately be determined by persons skilled in the art for each particular adaptation of the invention.

Figure 10:
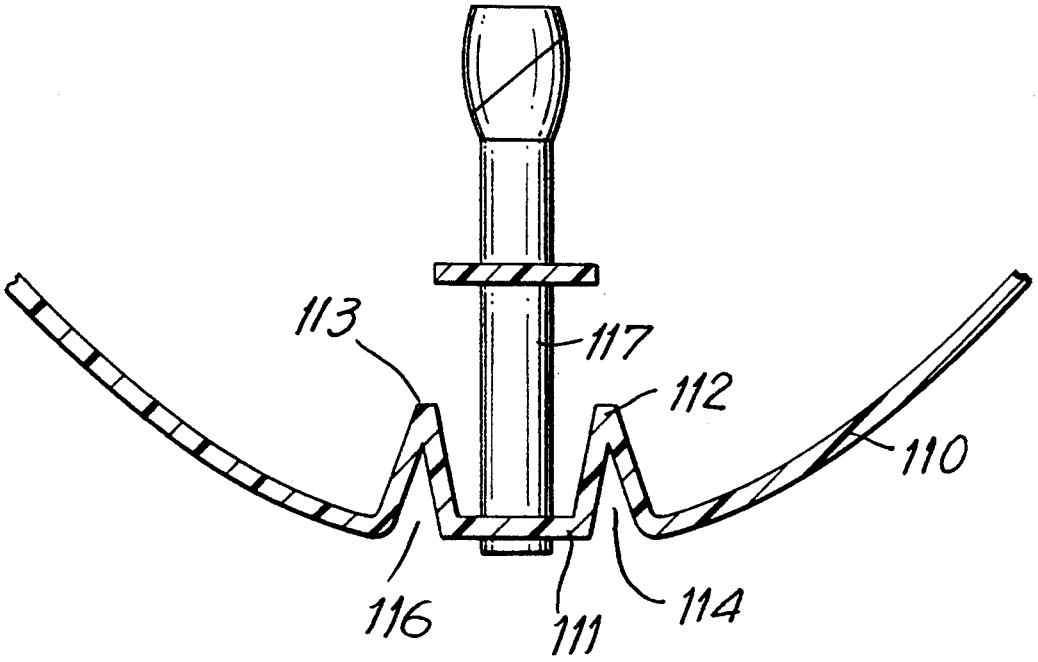
FIG. 10 is a fragmented elevational section of an inflatable showing the part thereof which includes a self-sealing valve and edge holder assembly of the type depicted in FIG. 1 and illustrating a still further embodiment of the present invention.

Referring now to FIG. 10, there is shown a still further embodiment of the present invention in which the edge holder assembly is located within the body 110 of the balloon or inflatable which therefore does not have a depending neck or stem such as has been described herein, for example, with respect to the embodiments of FIGS. 1 and 9. In this arrangement, an open-ended flap portion 111 is formed in the periphery of the balloon as a result of a pair of spaced apart inverted "V" or "U"-shaped heat seals 112 and 113. The material of the balloon is cut out as shown at 114 and 116 to define the boundaries of the flap portion 111. The seals 112 and 113 provide lateral support for a suitable fill tube 117 and supporting stick inserted therein (not shown). In obviating the need for a depending neck or stem as part of the balloon, the present embodiment reduces the amount and cost of plastic material required to produce the balloon structure and thereby helps reduce the amount of scrap waste generated during manufacture.

It should be understood that the figures and the specific description thereof set forth in this application are for the purpose of illustrating the present invention and are not to be construed as limiting the present invention to the precise and detailed specific structures shown in the drawing figures. Persons skilled in the art will recognize that various changes may be made in the detail construction without departing from the scope of the invention. For example, where a self-sealing tubular valve is utilized, it may be bonded to a sidewall of the balloon stem or to a sidewall of the balloon by a suitable heat seal, as desired. In addition, the fill chamber which defines the receptacle for the straw or stick holder and which, in some embodiments, contains the tubular self-sealing valve, may be formed by an indent in the overall shape of the balloon and therefore by an extension of the edge seals defining the periphery of the balloon body. It shall be understood that any such changes shall be within the spirit and scope of the present invention which is defined by the following claims.

What is claimed is:

1. An inflatable body and holder adapted to be filled with an inflation medium, comprising:

a plurality of overlying sealable panels having edge seal means joining said panels together to define the inflatable body, said edge seal means defining an inflation port, an adjacent pair of said panels defining an inflation conduit for communicating the inflation medium from said inflation port to the interior of the inflatable body, said adjacent pair of panels being located between adjoined panels defining external surfaces of the inflatable body, said edge seal means joining said adjacent pair of panels to said panels defining external surfaces of the inflatable body at a plurality of locations around the periphery of the inflatable body, at least one of said locations on the periphery of the inflatable body being substantially diametrically opposite said inflation port, an opening defined in at least one panel of said adjacent pair of panels to permit inflation medium to enter said inflatable body from said inflation conduit; and a holder element releasably insertable within said inflation conduit whereby the pressure of said inflation medium within the inflatable body when the inflatable body is filled presses said adjacent pair of panels against said holder element frictionally to secure said holder element within said inflation conduit along its length thereby providing sidewall support to hold the inflatable body rigidly relative to said holder element.

2. The assembly of claim 1, in which said adjacent pair of said panels further define a substantially inwardly projecting self-sealing valve of predetermined configuration.

3. The inflatable edge holder assembly of claim 1, in which said edge seal means define the boundary of a stem portion projecting from the inflatable body said stem portion having a portion of said inflation conduit therein.

4. The inflatable edge holder assembly of claim 3, wherein which said adjacent pair of said panels extends into said stem portion.

5. The assembly of claim 1, in which said opening is formed in a wall of said inflation conduit.

* * * * *

UNITED STATES PATENT AND TRADEMARK OFFICE

CERTIFICATE OF CORRECTION

PATENT NO. : 5,334,072

DATED : August 2, 1994

INVENTOR(S) : Marc I. Epstein

It is certified that error appears in the above-indentified patent and that said Letters Patent is hereby corrected as shown below:

On the title page, Item [63] should read --

Continuation-in-part of Ser. No. 753,829, Sep. 3, 1991, Pat. No. 5,306,194.

Signed and Sealed this

Eleventh Day of October, 1994

*Attest:*

Bruce Lehman

BRUCE LEHMAN

*Attesting Officer*

*Commissioner of Patents and Trademarks*